US007182143B2

(12) United States Patent
Hall et al.

(10) Patent No.: US 7,182,143 B2
(45) Date of Patent: Feb. 27, 2007

(54) AUTOMATIC APPLIANCE FIRE EXTINGUISHER SYSTEM

(76) Inventors: Neal Hall, 26985 Beach Rd., Brook Park, MN (US) 55007; Shelby Holen, 4211 S. Gareth Rd., Superior, WI (US) 54880

( * ) Notice: Subject to any disclaimer, the term of this patent is extended or adjusted under 35 U.S.C. 154(b) by 131 days.

(21) Appl. No.: 10/806,853

(22) Filed: Mar. 23, 2004

(65) Prior Publication Data

US 2004/0188102 A1 Sep. 30, 2004

Related U.S. Application Data

(60) Provisional application No. 60/456,926, filed on Mar. 24, 2003.

(51) Int. Cl.

| | |
|---|---|
| ***A62C 35/02*** | (2006.01) |
| ***A62C 35/10*** | (2006.01) |
| ***A62C 37/36*** | (2006.01) |
| ***A62C 35/60*** | (2006.01) |
| ***A62C 37/12*** | (2006.01) |
| ***A62C 37/11*** | (2006.01) |
| ***A62C 3/00*** | (2006.01) |

(52) U.S. Cl. ..... 169/26; 169/42; 169/23; 169/57; 169/65

(58) Field of Classification Search ..... 169/26, 169/42, 23, 57, 65, 56

See application file for complete search history.

(56) References Cited

U.S. PATENT DOCUMENTS

| | | | | |
|---|---|---|---|---|
| 3,800,878 A | * | 4/1974 | Poitras | 169/20 |
| 3,907,037 A | | 9/1975 | Linsalato et al. | |
| 4,299,289 A | | 11/1981 | Kato | |
| 4,341,267 A | * | 7/1982 | Lagasse | 169/54 |
| 4,527,635 A | * | 7/1985 | Kirchner | 169/26 |
| 4,675,541 A | | 6/1987 | Peters et al. | |
| 4,805,701 A | * | 2/1989 | Mountford | 169/57 |
| 4,834,188 A | | 5/1989 | Silverman | |
| 4,872,513 A | | 10/1989 | Gardner et al. | |
| 4,979,572 A | * | 12/1990 | Mikulec | 169/65 |
| 5,351,760 A | * | 10/1994 | Tabor, Jr. | 169/65 |

(Continued)

OTHER PUBLICATIONS

Aspen Manufacturing product literature, Jul. 22, 2003.

(Continued)

*Primary Examiner*—Kevin Shaver
*Assistant Examiner*—Darren Gorman
(74) *Attorney, Agent, or Firm*—Leffert Jay & Polglaze P.A.

(57) ABSTRACT

Embodiments of the invention provide fire extinguishers for appliances and methods. A fire extinguisher includes a container containing a pressurized fire retardant. A delivery tube is connected to the container and is in fluid communication with the pressurized fire retardant. A fusible tip is disposed at a distal end of the delivery tube that seals the delivery tube. The fusible tip is adapted to release the fire retardant from the container upon melting of the fusible tip when the fusible the tip is exposed to a temperature that exceeds its melting temperature. A pressure-actuated switch may be connected to the container in fluid communication with the pressurized fire retardant. The pressure-activated switch is adapted to shut down an appliance in which the distal end is disposed when the pressure within the container drops below a predetermined value as a result of releasing the fire retardant into the appliance.

18 Claims, 4 Drawing Sheets

U.S. PATENT DOCUMENTS

| | | | | |
|---|---|---|---|---|
| 5,697,450 | A | 12/1997 | Stehling et al. | |
| 5,868,205 | A | 2/1999 | Cunninhgam et al. | |
| 6,029,751 | A | 2/2000 | Ford et al. | |
| 6,044,913 | A | 4/2000 | Stehling et al. | |
| 6,118,381 | A | 9/2000 | James | |
| 6,131,667 | A | 10/2000 | Jesadanont | |
| 6,189,624 | B1 | 2/2001 | James | |
| 6,341,655 | B1 | 1/2002 | Busian et al. | |
| 6,360,825 | B1 | 3/2002 | Padgett et al. | |
| 6,648,077 | B2 * | 11/2003 | Hoffman | 169/56 |
| 2002/0112863 | A1 | 8/2002 | Padgett et al. | |

OTHER PUBLICATIONS

JLA S.A.F.E. product literature, Jan. 24, 2003.

Kidde Aerospace, Abbreviated Component Maintenance Manual (ACMM)- Disposable Fire Extinguishers, pp. 1-9, Aug. 5, 2002.

* cited by examiner

AUTOMATIC APPLIANCE FIRE EXTINGUISHER SYSTEM

CROSS REFERENCE TO RELATED APPLICATIONS

This application is related to and claims the benefit of the filing date of co-pending provisional application U.S. Ser. No. 60/456,926, filed on Mar. 24, 2003, which application is incorporated herein by reference.

TECHNICAL FIELD OF THE INVENTION

This invention relates to fire extinguisher systems.

BACKGROUND OF THE INVENTION

Appliance fires, such as furnace fires and clothes dryer fires, are a persistent problem. Appliance fires result in significant property damage, injury and death each year. According to statistics reported by the National Fire Protection Association, there were 14,300 residential clothes dryer fires in the United States in 1998, resulting in 19 deaths, 312 injuries and $67.7 million in direct property damage. *U.S. Home Product Report: Appliances and Equipment Involved in Fires*, NFPA Journal, January, 2002.

For the reasons stated above, and for other reasons stated below which will become apparent to those skilled in the art upon reading and understanding the present specification, there is a need in the art for fire extinguishing systems for appliances.

SUMMARY

The above-mentioned problems with appliance fires and other problems are addressed by the present invention and will be understood by reading and studying the following specification.

One embodiment of the invention provides an appliance fire extinguisher that includes a container containing a pressurized fire retardant. A delivery tube is connected to the container and is in fluid communication with the pressurized fire retardant. A fusible tip is disposed at a distal end of the delivery tube that seals the delivery tube. The distal end is disposable within the appliance and is adapted to release the fire retardant from the container into the appliance upon melting of the fusible tip when the fusible tip is exposed to a temperature that exceeds its melting temperature.

Another embodiment provides a fire extinguisher system having a container containing a pressurized fire retardant. A plurality of delivery tubes is connected to the container and is in fluid communication with the pressurized fire retardant. A fusible tip is disposed at a distal end of each of the delivery tubes that seals the respective delivery tubes. Each of the distal ends is respectively disposable in a different appliance and wherein each fusible tip is adapted to release the fire retardant from the container through its respective delivery tube into its respective appliance upon melting of that fusible tip when that fusible tip is exposed to a temperature that exceeds its melting temperature.

Further embodiments of the invention include methods and apparatus of varying scope.

DETAILED DESCRIPTION

Figure 1:
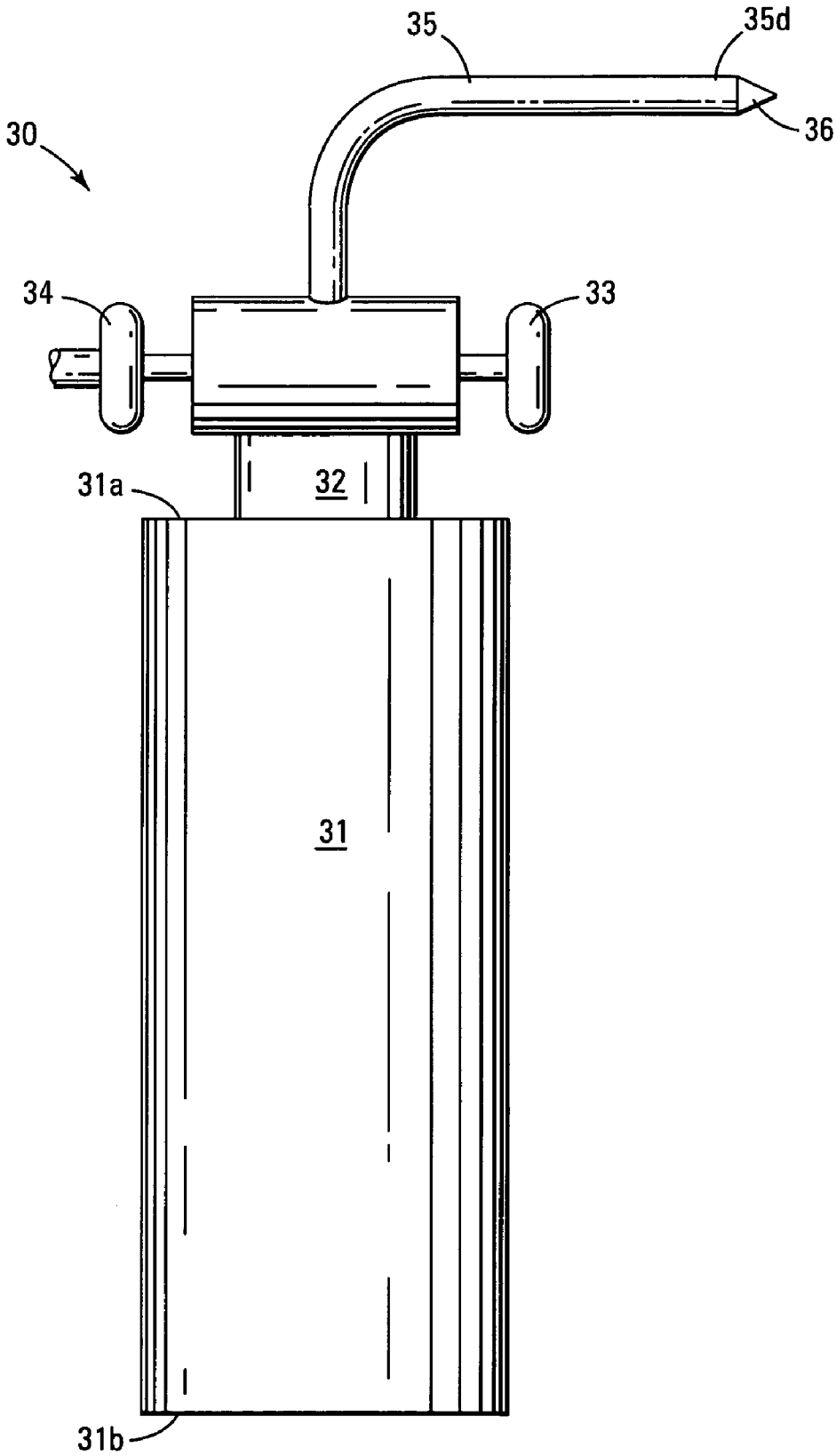
FIG. 1 is front view of one embodiment of a heat-activated fire extinguisher component of the invention.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims and equivalents thereof.

Figure 2:
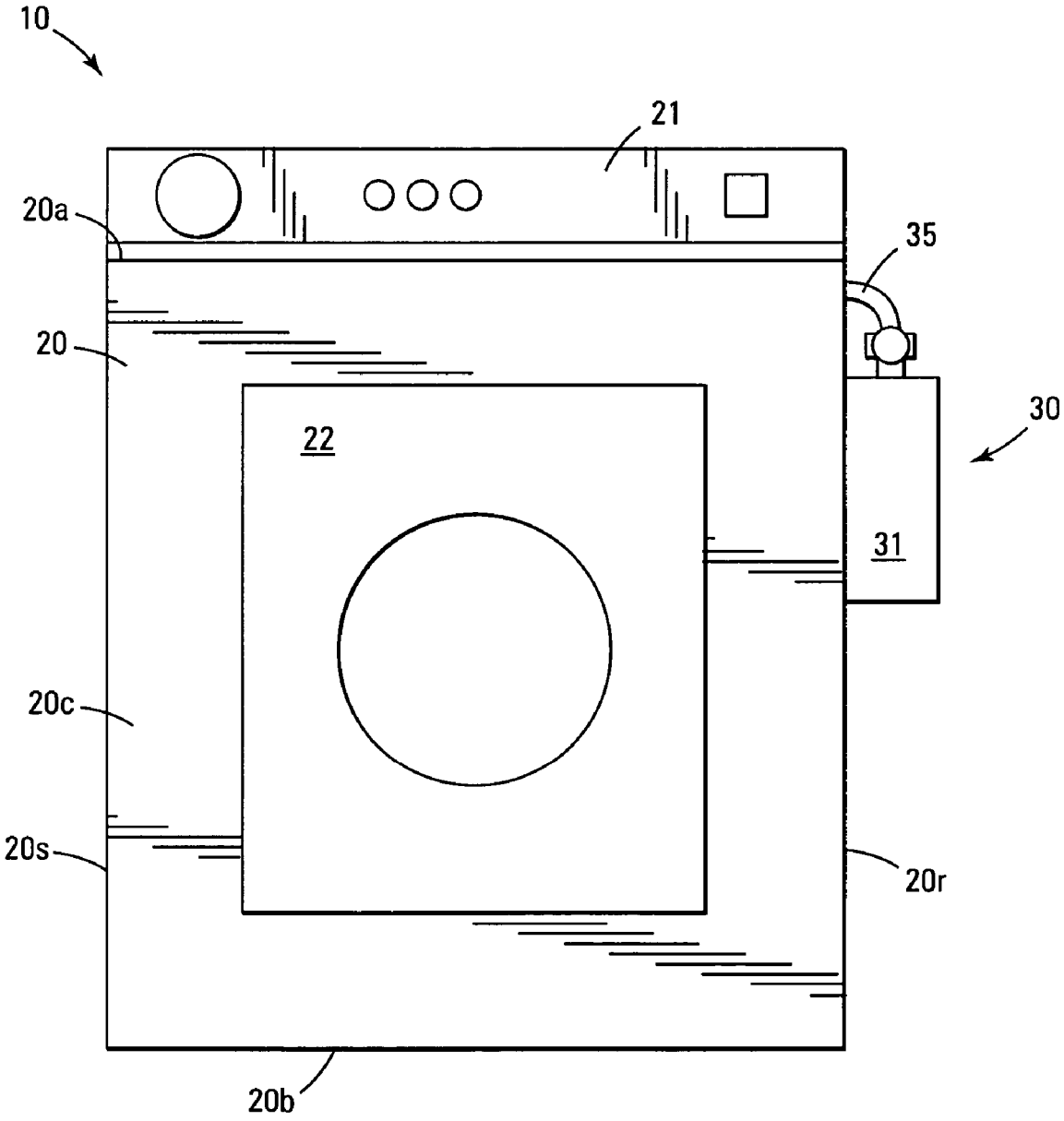
FIG. 2 is side view of the heat-activated fire extinguisher shown in FIG. 1 externally mounted onto an appliance according to another embodiment of the present invention.
Figure 3:
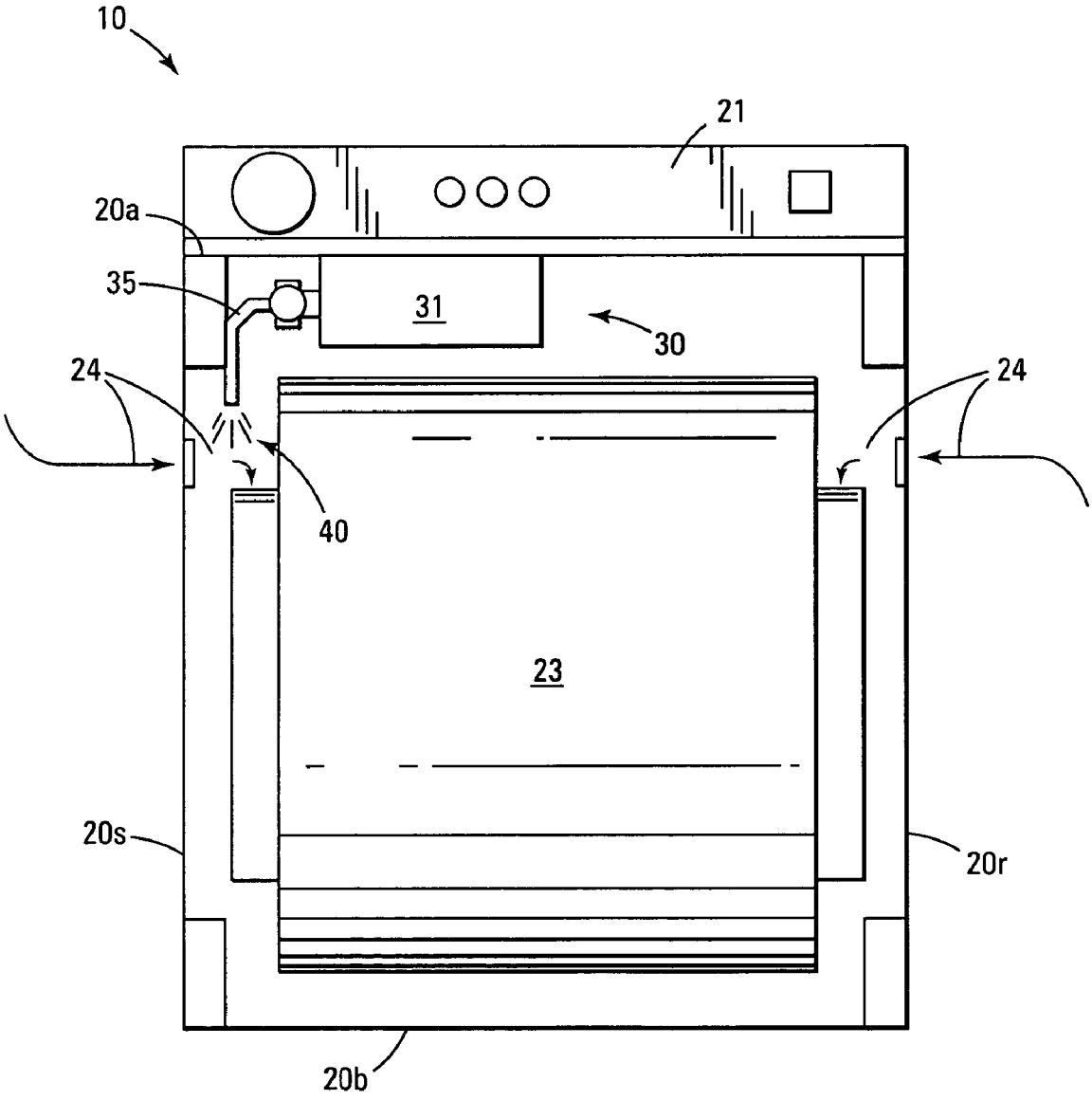
FIG. 3 is top view of the heat-activated fire extinguisher shown in FIG. 1 internally mounted within an appliance with the top of the appliance open to facilitate viewing of the internal components according to another embodiment of the present invention.

The invention is an automatic fire extinguishing system 10 for appliances 20, as shown in FIG. 2. The system includes a heat-activated fire extinguisher 30, shown in FIG. 1, that is mountable on an appliance 20, as shown in FIG. 2. For one embodiment, fire extinguisher 30 is configured and arranged to discharge a fire retardant 40 into the air intake path 24 of the appliance 20, as shown in FIG. 3. For one embodiment, appliance 20 has a body having a top 20*a*, a bottom 20*b*, a right side 20*r*, a left side 20*s*, and a front door 22, as shown in FIG. 2. For another embodiment, appliance 20 has a tumbler 23, as shown in FIG. 3, such as a drying tumbler.

The automatic fire extinguishing system can be effectively utilized with any appliance 20 having an air intake path 24, including specifically, but not exclusively, electric and gas clothes dryers, electric and gas furnaces, ventilation hoods for stoves, microwave ovens, gas-powered electrical generators, a fireplace chimney, a wood stove chimney etc.

The fire extinguisher 30 retains a suitable pressurized fire retardant 40 within a container 31 having a top 31*a* and a bottom 31*b*. The container 31 can be shaped as desired for internal or external mounting on the appliance 20. As shown in FIGS. 1–3, the common cylindrical container 31 can be employed. The size of the container 31 should be selected based upon the appliance 20 upon which the fire extinguisher 30 is to be employed. Typically, a container 31 of between about 0.2 to about 1 gallon will be effective for most applications. A container 31 of less than about 0.2 gallons may not provide sufficient fire retardant 40 to extinguish some fires. For some embodiments, a container 31 of greater than about 1 gallon may be used.

The fire retardant 40 should be selected from those retardants known to be effective against the type of fire (i.e., class A, B or C) typically created by the appliance 20 upon which the fire extinguisher 30 is to be mounted.

Most fires emanating from an electrical appliance 20 will be a Class C fire (i.e., a fire caused by electricity). Electrical fires are extinguished by turning off the electrical power and smothering the fire with carbon dioxide, a halogen compound or dry chemicals. Never use water. Water will conduct electricity and you could easily be electrocuted. Carbon dioxide is a gas which can be compressed into the container 31. Carbon dioxide is discharged from the extinguisher 30 as a gas and will travel a short distance (about 3 to 8 feet) through the air intake path 24 of the appliance 20. Halogenated compounds are special chemical gas compounds that can be compressed into the container 31. As with carbon dioxide, halogenated compounds are discharged from the extinguisher 30 as a gas and will travel a short distance (about 3 to 8 feet) through the air intake path 24 of the appliance 20. Chemical extinguishers use a chemical powder and compressed air, compressed nitrogen gas or compressed carbon dioxide gas to discharge the powder.

Most fires emanating from a natural gas appliance 20 will be a Class A fire (i.e., an ordinary combustible fire). Natural gas fires are extinguished by turning off the supply of natural gas and smothering the fire with water, carbon dioxide, or multi-purpose dry chemicals. Water extinguishers use water or an anti-freeze solution combined with compressed air, compressed nitrogen gas or compressed carbon dioxide gas to create pressure, causing the water to spray out of the extinguisher.

A neck 32 extends from the top 31*a* of the container 31. A pressure gauge 33 may be positioned on the neck 32 in fluid communication with the pressurized fire retardant 40 within the container 31 for visually indicating the pressure within the container 31 so as to provide a signal to recharge or replace the extinguisher 30. Note that for one embodiment, container 31 is adapted to be recharged with fire retardant.

A pressure-actuated deactivation switch 34 may also be positioned on the neck 32 in fluid communication with the pressurized fire retardant 40 within the container 31. The pressure actuated deactivation switch 34 is a normally CLOSED switch which OPENS only when the pressure within the container 31 falls below a threshold value. By interposing the deactivation switch 34 into an electrical circuit (not shown) for providing power to the appliance 20, the deactivation switch 34 can shut off power to the appliance 20 whenever fire retardant 40 is discharged from the extinguisher 30 (i.e., discharge of fire retardant 40 from the container 31 causes the pressure to fall below the threshold value, thereby causing the deactivation switch 34 to OPEN and shut off power to the appliance 20). An alarm, such as alarm 440 of FIG. 4, can also be provided in electrical communication with the deactivation switch 34 for generating an alarm when the deactivation switch 34 is OPEN. For one embodiment, deactivation switch 34 is a normally open switch that is held closed by the pressure within container 31.

If desired, a valve (not shown) may also be positioned on the neck 32 in fluid communication with the pressurized fire retardant 40 within the container 31 for permitting recharging of the extinguisher 30.

A delivery tube 35 extends from the neck 32 for delivery of fire retardant 40 from the container 31 into the air intake path 24 of an appliance 20. The delivery tube 35 is in fluid communication with the pressurized fire retardant 40 within the container 31. The distal end 35*d* of the delivery tube 35 is sealed with a fusible tip or closure, such as a low-temperature solder tip 36. The low temperature solder tip 36 is selected so that the tip 36 will melt and release fire retardant 40 from the container 31 through the distal end 35*d* of the delivery tube 35 when the temperature exceeds the normal operating temperature of the appliance 20 such as would result in the event of a fire within the appliance 20.

The melt temperature of the solder tip 36 should be selected based upon the normal operating temperature of the appliance 20 upon which the extinguisher 30 is to be employed, with the melt temperature selected to be about 20° F. to about 60° F. greater than then normal operating temperature of the appliance 20. Typically, a melt temperature of between about 120° F. to about 180° F. will be effective for most applications. A melt temperature of less than about 120° F. will tend to result in accidental discharges while a temperature of greater than about 180° F. may permit a fire to burn for an extended period of time before fire retardant 40 is discharged from the extinguisher 30. Of course, the melt temperature can be chosen based on the environment, so lower or higher melt temperatures are within the scope of the invention.

As shown in FIGS. 2 and 3, the container 31 can be internally or externally mounted on the appliance 20 with the distal end 35*d* of the delivery tube 35 positioned within the air intake path 24 of the appliance 20. The pressure gauge 33, pressure actuated deactivation switch 34, and/or the recharging valve (not shown) may be remotely located on the appliance 20 (e.g., on the control panel 21 of the appliance 20) so long as they remain in communication with the fire retardant 40 within the container 31. Alternatively, a central processing unit (not shown) may be employed for receiving an electrical signal indicating the pressure within the extinguisher 30 and controlling the various gauges based upon the sensed pressure.

A superior fire extinguishing effect can be achieved by limiting the discharge rate of fire retardant 40 from the fire extinguisher 30 so as to provide a controlled and sustained release of fire retardant 40 into the air intake path 24 of the appliance 20 over a span of about 5 to 20 seconds, and delaying deactivation of the appliance 20 for a similar span of 5 to 20 seconds after initiating discharge of fire retardant 40 from the fire extinguisher 30 so as to allow fire retardant 40 to be pulled into and dispersed throughout the appliance 20 via the air intake path 24 before shutting down the appliance 20. Limitation of the discharge rate can be achieved by any of several methods, including specifically but not exclusively limiting the size of the bore (not shown) through the delivery tube 35 and attachment of a spray nozzle (not shown) proximate the distal end 35*d* of the delivery tube 35. Disposing an orifice within the delivery tube 35 is another suitable way of limiting the discharge rate. Deactivation of the appliance 20 can then be delayed by simply setting a very low threshold pressure value at which the deactivation switch 34 will OPEN.

Figure 4:
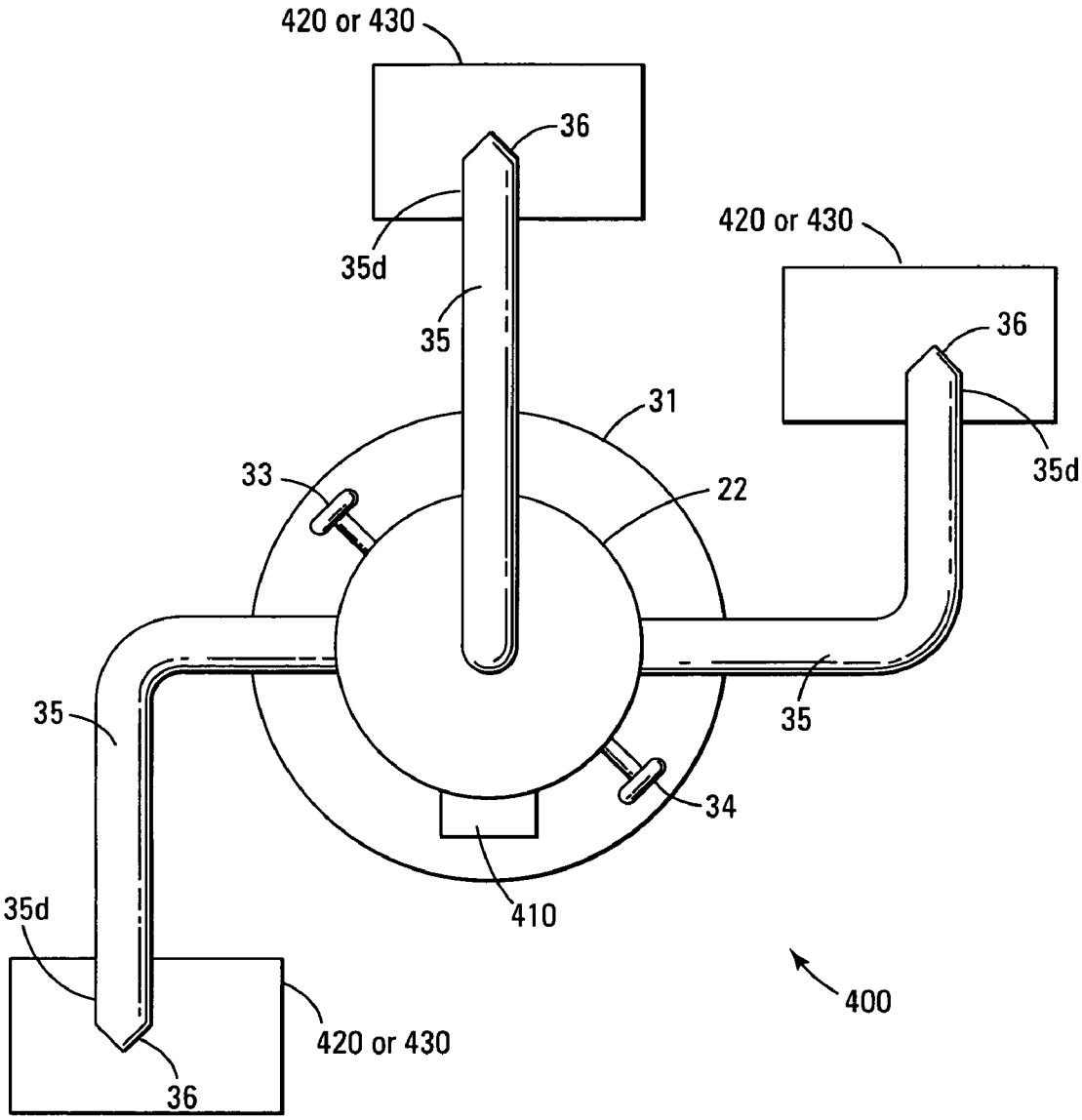
FIG. 4 is a top view of an automatic fire extinguishing system according to another embodiment of the present invention.

FIG. 4 is a top view of an automatic fire extinguishing system 400 according to another embodiment of the present invention. Automatic fire extinguishing system 400 includes a plurality of delivery tubes 35 connected to the neck 32 of the container 31, each of the tubes 35 in fluid communication with the pressurized fire retardant contained in the container 31.

For one embodiment, as shown in FIG. 4, container 31 is located at a remote location, and the distal end 35*d* of each of delivery tubes 35 is located in a different appliance 420 or a different compartment or location 430 within a single appliance 20, such as described above. For example, a first distal end 35*d* of a first delivery tube 35 may be located in a dryer, a second distal end 35*d* of a second delivery tube 35 may be located in a furnace or a chimney, a third distal end 35*d* of a third delivery tube 35 may be located in a stove hood, etc. Alternatively, each of the first, second, and third distal ends 35 may be located in different locations within a dryer, furnace, stove hood, etc. and are not confined to an air intake path, such as air intake path 24 of the appliance 20, shown in FIG. 3. For some embodiments where the distal ends 35 are located at different locations within a single appliance 20, container 31 can be mounted as shown in FIG. 2 or FIG. 3.

When the temperature in one or more of appliances 420 or locations 430 reaches a predetermined temperature, the respective solder tip 36 melts allowing fire retardant to flow into the one or more appliances 420 or locations 430. For one embodiment, solder tips 36 have different melting temperatures based on the normal operation temperature of the respective appliances 420 or at the respective locations 430. That is, at least one of the solder tips has a melting temperature that is different from the melting temperatures of the remaining solder tips.

For one embodiment, a pressure-activated alarm 410 is connected to neck 32 and is in communication with the pressurized fire retardant contained in container 31. Alarm 410 is held in a deactivated state by the pressure in container 31. If the pressure drops below a predetermined pressure level, the alarm activates, e.g., emitting an audible sound. A suitable alarm 410 may include a normally closed pressure-activated switch that is interposed between a power source and a sound emitter, such as a horn, buzzer, or the like, and that is held open by the pressure in container 31. If the pressure drops below the predetermined pressure level, the switch closes causing current to flow from the power supply to the sound emitter, thereby activating the sound emitter. Therefore, the alarm sounds after fire retardant is expelled into one or more of appliances 420 or locations 430.

For some embodiments where the distal ends 35 are located at different locations within a single appliance 20, the deactivation switch 34 is connected to the power supply circuit of the appliance 20 for turning the appliance off when the pressure within container 31 drops below the threshold pressure as a result of fire retardant being expelled from container 31 through one or more of the delivery tubes 35.

CONCLUSION

Embodiments of the invention provide fire extinguishers for appliances. For one embodiment, a fire extinguisher includes a container containing a pressurized fire retardant. A delivery tube is connected to the container and is in fluid communication with the pressurized fire retardant. A fusible tip is disposed at a distal end of the delivery tube that seals the delivery tube. The fusible tip is adapted to release the fire retardant from the container upon melting of the fusible tip when the fusible the tip is exposed to a temperature that exceeds its melting temperature. A pressure-actuated switch is connected to the container and in fluid communication with the pressurized fire retardant. A pressure-actuated alarm may be connected to the container for fluid communication with the pressurized fire retardant. The alarm is adapted to generate an alarm when the pressure in the container drops below the predetermined value. The distal end is disposable within an appliance, such as a clothes-dryer, stove-hood, furnace, microwave oven, a gas-powered electrical generator, etc. The pressure-activated switch is adapted to shut down the appliance when the pressure within the container drops below a predetermined value as a result of releasing the fire retardant into the appliance.

Additional delivery tubes may be connected to the container for fluid communication with the fire retardant. A fusible tip is disposed at a distal end of each of the additional delivery tubes that seals the respective additional delivery tubes. Each fusible tip is adapted to release the fire retardant from the container through its respective delivery tube upon melting of that fusible tip when that fusible the tip is exposed to a temperature that exceeds its melting temperature. Each of the distal ends is respectively disposable in a different appliance or at a different location within a single appliance.

Although specific embodiments have been illustrated and described herein, it will be appreciated by those of ordinary skill in the art that any arrangement that is calculated to achieve the same purpose may be substituted for the specific embodiments shown. For example, the location of distal end 35 is not confined to an air intake path, such as air intake path 24 of the appliance 20. Rather, distal end 35 may be located at any location within an appliance. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. An appliance fire extinguisher comprising:

a container containing a pressurized fire retardant;

a delivery tube connected to the container and in fluid communication with the pressurized fire retardant;

a fusible tip disposed at a distal end of the delivery tube that seals the delivery tube, wherein the distal end is disposable within the appliance and wherein the fusible tip is adapted to release the fire retardant from the container into the appliance upon melting of the fusible tip when the fusible tip is exposed to a temperature that exceeds its melting temperature; and a pressure-actuated switch connected to the container and in fluid communication with the pressurized fire retardant, wherein the pressure-actuated switch is connectable to a power supply circuit of the appliance for shutting off power to the appliance when a pressure in the container drops below a predetermined value as a result of the fire retardant being released from the container.

2. The appliance fire extinguisher of claim 1, wherein the pressure-actuated switch is held closed by a pressure in the container and is adapted to open when the pressure in the container drops below a predetermined value as a result of the fire retardant being released from the container.

3. The appliance fire extinguisher of claim 1, and further comprising a pressure indicator connected to the container and in fluid communication with the pressurized fire retardant.

4. The appliance fire extinguisher of claim 1, wherein the fire retardant is a powder.

5. The appliance fire extinguisher of claim 1, further comprising an alarm adapted to generate an alarm when a pressure in the container drops below a predetermined value as a result of the fire retardant being released from the container.

6. The appliance fire extinguisher of claim 1, wherein the fusible tip is solder.

7. The appliance fire extinguisher of claim 1, wherein the distal end is disposable within an air intake path of the appliance.

8. The appliance fire extinguisher of claim 1, wherein the appliance is selected from the group consisting of clothes dryers, stove hoods, furnaces, microwave ovens, gas-powered electrical generators, and chimneys.

9. An appliance fire extinguisher comprising:

a container containing a pressurized fire retardant, wherein the fire retardant is a powder and the container is mountable on the appliance;

a delivery tube connected to the container and in fluid communication with the pressurized fire retardant;

a solder tip disposed at a distal end of the delivery tube that seals the delivery tube, wherein the distal end is disposable within the appliance and wherein the solder tip is adapted to release the fire retardant from the container into the appliance upon melting of the solder tip when the solder tip is exposed to a temperature that exceeds its melting temperature;

a pressure-actuated switch connected to the container and in fluid communication with the pressurized fire retardant, wherein the pressure-actuated switch is connectable to a power supply circuit of the appliance for shutting off power to the appliance when a pressure in the container drops below a predetermined value as a result of the fire retardant being released from the container; and a pressure indicator connected to the container and in fluid communication with the pressurized fire retardant.

10. The appliance fire extinguisher of claim 9, wherein the distal end is disposable within an air intake path of the appliance.

11. An appliance comprising:

a fire extinguisher, comprising:

a container containing a pressurized fire retardant;

a delivery tube connected to the container and in fluid communication with the pressurized fire retardant;

a fusible tip disposed at a distal end of the delivery tube that seals the delivery tube, the fusible tip disposed at a location within the appliance, wherein the fusible tip is adapted to release the fire retardant from the container into the appliance upon melting of the fusible tip when the temperature at the location within the appliance exceeds the melting temperature of the fusible tip; and a pressure-actuated switch connected to the container and in fluid communication with the pressurized fire retardant, wherein the pressure-actuated switch is connected to a power supply circuit of the appliance for shutting off power to the appliance when a pressure in the container drops below a predetermined value as a result of the fire retardant being released from the container.

12. The appliance of claim 11, wherein the location within the appliance corresponds to an air intake path of the appliance.

13. The appliance of claim 11, wherein the pressure-actuated switch is mounted on a control panel of the appliance.

14. The appliance fire extinguisher of claim 1, and further comprising:

a plurality of additional delivery tubes connected to the container and in fluid communication with the pressurized fire retardant; and a fusible tip disposed at a distal end of each of the additional delivery tubes that seals the respective delivery tubes, wherein each of the distal ends is respectively disposable in a different appliance and wherein each fusible tip is adapted to release the fire retardant from the container through its respective delivery tube into its respective appliance upon melting of that fusible tip when that fusible tip is exposed to a temperature that exceeds its melting temperature.

15. The appliance fire extinguisher of claim 14, wherein at least one of the fusible tips has a melting temperature that is different from the melting temperatures of the other fusible tips.

16. The appliance fire extinguisher of claim 14, and further comprising a pressure-actuated alarm connected to the container and in fluid communication with the pressurized fire retardant, the alarm adapted to generate an alarm when a pressure in the container drops below a predetermined value as a result of the fire retardant being released from the container.

17. The appliance of claim 11, the extinguisher further comprising:

a plurality of additional delivery tubes connected to the container and in fluid communication with the pressurized fire retardant; and a fusible tip disposed at a distal end of each of the additional delivery tubes that seals the respective delivery tubes, wherein each of the distal ends is respectively disposable in a different appliance and wherein each fusible tip is adapted to release the fire retardant from the container through its respective delivery tube into its respective appliance upon melting of that fusible tip when that fusible tip is exposed to a temperature that exceeds its melting temperature.

18. The appliance of claim 11, and further comprising a pressure-actuated alarm connected to the container and in fluid communication with the pressurized fire retardant, the alarm adapted to generate an alarm when the pressure in the container drops below a predetermined value as a result of the fire retardant being released from the container.

* * * * *